US010486876B2

(12) United States Patent
Vagnoni et al.

(10) Patent No.: US 10,486,876 B2
(45) Date of Patent: Nov. 26, 2019

(54) HANG TAG

(71) Applicants: Robert Bosch Tool Corporation, Broadview, IL (US); Robert Bosch GmbH, Stuttgart (DE)

(72) Inventors: Adrian Vagnoni, Arlington Heights, IL (US); Bobby Brent Boyd, Gilberts, IL (US); Markus Thomas Rech, Ipsach (CH); Asmus Mueller, Bettlach (CH)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 182 days.

(21) Appl. No.: 15/617,846

(22) Filed: Jun. 8, 2017

(65) Prior Publication Data

US 2018/0354693 A1 Dec. 13, 2018

(51) Int. Cl.

| | |
|---|---|
| ***B65D 85/20*** | (2006.01) |
| ***B65D 73/00*** | (2006.01) |
| ***B25H 3/00*** | (2006.01) |

(52) U.S. Cl.

CPC ..... *B65D 73/0064* (2013.01); *B25H 3/003* (2013.01); *B65D 73/0042* (2013.01)

(58) Field of Classification Search

USPC ..... 206/349, 379, 478, 806, 376; 211/69, 211/70.6; 40/673; D9/415; 248/309.1

See application file for complete search history.

(56) References Cited

U.S. PATENT DOCUMENTS

| | | | | | |
|---|---|---|---|---|---|
| 3,978,984 | A * | 9/1976 | Cowley | B65D 73/0007 | 206/379 |
| 4,171,050 | A * | 10/1979 | Murray | B65D 73/0085 | 206/446 |
| 4,909,386 | A * | 3/1990 | Jeffers | B25H 3/003 | 206/379 |
| 5,484,056 | A * | 1/1996 | Wood | B65D 73/0064 | 206/349 |
| 5,906,350 | A * | 5/1999 | Kao | A47F 7/0028 | 206/349 |
| 5,979,652 | A * | 11/1999 | Rosler | B65D 73/0064 | 206/349 |

(Continued)

FOREIGN PATENT DOCUMENTS

| | | |
|---|---|---|
| CN | 203698889 | 7/2014 |
| DE | 19827747 | 12/1999 |

*Primary Examiner* — Gideon R Weinerth

(74) *Attorney, Agent, or Firm* — Kathy K. Takeguchi; Maginot, Moore & Beck LLP

(57) ABSTRACT

A product display package for an object includes a display portion and a retaining portion. The display portion includes a frame structure with at least one opening that provides a view of the object when disposed in the product display package. The retaining portion includes a first retaining part and a second retaining part. The first retaining part includes a first holding portion with a first set of ribs configured to engage the object. The first set of ribs is angled with respect to a longitudinal axis of the product display package. The second retaining part is configured to mate with the first retaining part such that the second retaining part is secured to the first retaining part. The second retaining part includes a second holding portion with a second set of ribs configured to engage the object.

20 Claims, 13 Drawing Sheets

(56) References Cited

U.S. PATENT DOCUMENTS 6,241,092 B1 * 6/2001 Vasudeva ..... B65D 25/103 206/349
6,679,379 B1 * 1/2004 Kao ..... A47F 5/0006 206/349
6,732,989 B1 * 5/2004 Kao ..... A47F 5/0006 206/349
6,837,373 B2 * 1/2005 Huang ..... A45F 5/021 206/376
6,840,389 B2 * 1/2005 Chen ..... B65D 73/0014 206/349
7,210,663 B2 * 5/2007 Wheeler ..... A47F 5/0006 206/349
7,392,902 B2 * 7/2008 Chang ..... A47F 5/0006 206/349
7,416,082 B2 8/2008 Roesler
7,624,865 B2 12/2009 Pendergraph et al.
8,186,512 B2 * 5/2012 Bertken ..... B65B 15/00 206/461
8,336,710 B2 * 12/2012 Chang ..... B65D 73/0064 206/349
9,073,202 B2 * 7/2015 Wang ..... B25H 3/04
9,511,917 B2 * 12/2016 Ou ..... B25H 3/00
10,000,322 B2 * 6/2018 Nowacki ..... B65D 83/08
2004/0124106 A1 * 7/2004 Chen ..... B25H 3/006 206/376
2005/0061757 A1 * 3/2005 Chiang ..... B65D 73/0064 211/70.6
2005/0067307 A1 * 3/2005 Kao ..... B65D 73/0064 206/349
2005/0098462 A1 * 5/2005 Hernandez, Jr. ... B65D 73/0064 206/376
2005/0252870 A1 * 11/2005 Roesler ..... B65D 73/0042 211/69
2006/0201836 A1 * 9/2006 Pendergraph ..... B65D 73/0064 206/379
2006/0283769 A1 * 12/2006 Roesler ..... B25H 3/023 206/588
2007/0138043 A1 * 6/2007 Roesler ..... B25H 3/003 206/379
2007/0163915 A1 * 7/2007 Wu ..... B65D 73/0014 206/495
2008/0179265 A1 * 7/2008 Lin ..... A47F 7/0028 211/70.6
2012/0234709 A1 9/2012 Chang
2015/0209956 A1 * 7/2015 Hu ..... B65D 73/0064 206/349
2016/0023829 A1 1/2016 Pendergraph
2016/0280438 A1 * 9/2016 Ou ..... B25H 3/00
2016/0288971 A1 * 10/2016 Ou ..... B65D 73/005
2017/0174407 A1 * 6/2017 Winkler ..... B25H 3/003
2018/0002088 A1 1/2018 Nowacki et al.
2018/0072475 A1 * 3/2018 Su ..... A47F 5/0861
2018/0354693 A1 * 12/2018 Vagnoni ..... B65D 73/0064

* cited by examiner

HANG TAG

FIELD

This disclosure relates generally to product display packages, and more specifically to configurations of hang tags by which products can be hung on displays.

BACKGROUND

Product display packages are typically used to exhibit products, for example, in retail stores, and often in a manner designed to promote the products while also providing product and retail information. In addition, some product display packages may include security tags. However, there are some downsides to these conventional product display packages. For example, in the case of drill bits, there are some product display packages that are expensive to manufacture, wasteful in material, large to store, prone to damage, easy to remove, etc.

For example, a hang tag is an example product display package used for displaying a drill bit, but from which the drill bit is often easily removable. Unfortunately, some shoplifters take advantage of these types of product display packages by removing the drill bits from their product display packages in order to separate the drill bits from the security tags and steal the drill bits from the store. Also, if the product display packages are easy to remove, then some shoppers may swap the product tag of a more expensive drill bit with the product tag of a less expensive drill bit in order to pay less money for the more expensive drill bit. In each of these cases, there is a substantial amount of loss.

SUMMARY

The following is a summary of certain embodiments described in detail below. The described aspects are presented merely to provide the reader with a brief summary of these certain embodiments and the description of these aspects is not intended to limit the scope of this disclosure. Indeed, this disclosure may encompass a variety of aspects that may not be explicitly set forth below.

In an example embodiment, a display package for an object includes a display portion and a retaining portion. The display portion includes a frame structure with at least one opening that provides a view of the object when disposed in the product display package. The retaining portion includes a first retaining part and a second retaining part. The first retaining part includes a first holding portion with a first set of ribs configured to engage the object. The first set of ribs is angled with respect to a longitudinal axis of the product display package. The second retaining part is configured to mate with the first retaining part such that the second retaining part is secured to the first retaining part. The second retaining part includes a second holding portion with a second set of ribs configured to engage the object.

In an example embodiment, a hang tag for an object includes a retaining portion. The retaining portion includes a first retaining part and a second retaining part. The first retaining part includes a first side with a ridge and angled surfaces. In addition, the first retaining part includes a second side with a first holding portion having a first set of ribs configured to engage the object. The second retaining part is configured to mate with the first retaining part such that the second retaining part is secured to the first retaining part. The second retaining part includes a second holding portion with a second set of ribs, which are configured to engage the object.

In an example embodiment, an apparatus includes a drill bit and a hang tag. The drill bit has a shank at one end portion and a cutting edge at another end portion. The hang tag is configured to hold the drill bit with the cutting edge pointing upward when the hang tag is hung in an upright manner. The hang tag includes a display portion and a retaining portion. The display portion includes a frame structure with at least one opening that provides a view of the cutting edge when the drill bit is disposed in the hang tag. The retaining portion includes a first retaining part and a second retaining part. The first retaining part that includes a first holding portion with a first set of ribs configured to engage flutes of the drill bit. The second retaining part is configured to mate with the first retaining part such that the second retaining part is secured to the first retaining part. The second retaining part includes a second holding portion with a second set of ribs configured to engage flutes of the drill bit.

These and other features, aspects, and advantages of this disclosure are further clarified by the following detailed description of certain exemplary embodiments in view of the accompanying drawings throughout which like characters represent like parts.

DETAILED DESCRIPTION

The embodiments described above, which have been shown and described by way of example, and many of their advantages will be understood by the foregoing description, and it will be apparent that various changes can be made in the form, construction, and arrangement of the components without departing from the disclosed subject matter or without sacrificing one or more of its advantages. Indeed, the described forms of these embodiments are merely explanatory. These embodiments are susceptible to various modifications and alternative forms, and the following claims are intended to encompass and include such changes and not be limited to the particular forms disclosed, but rather to cover all modifications, equivalents, and alternatives falling with the spirit and scope of this disclosure.

The present disclosure relates to a product display package, particularly a hang tag 200, which is a display and suspension structure for an object. In an example embodiment, the hang tag 200 is configured to receive, hold, and suspend an elongated object, such as a tool. For instance, the tool is a drill bit 300, such as that configured for a drill system. Also, other objects can be similarly received, held, and suspended by the hang tag 200 in other example embodiments.

Figure 1A:
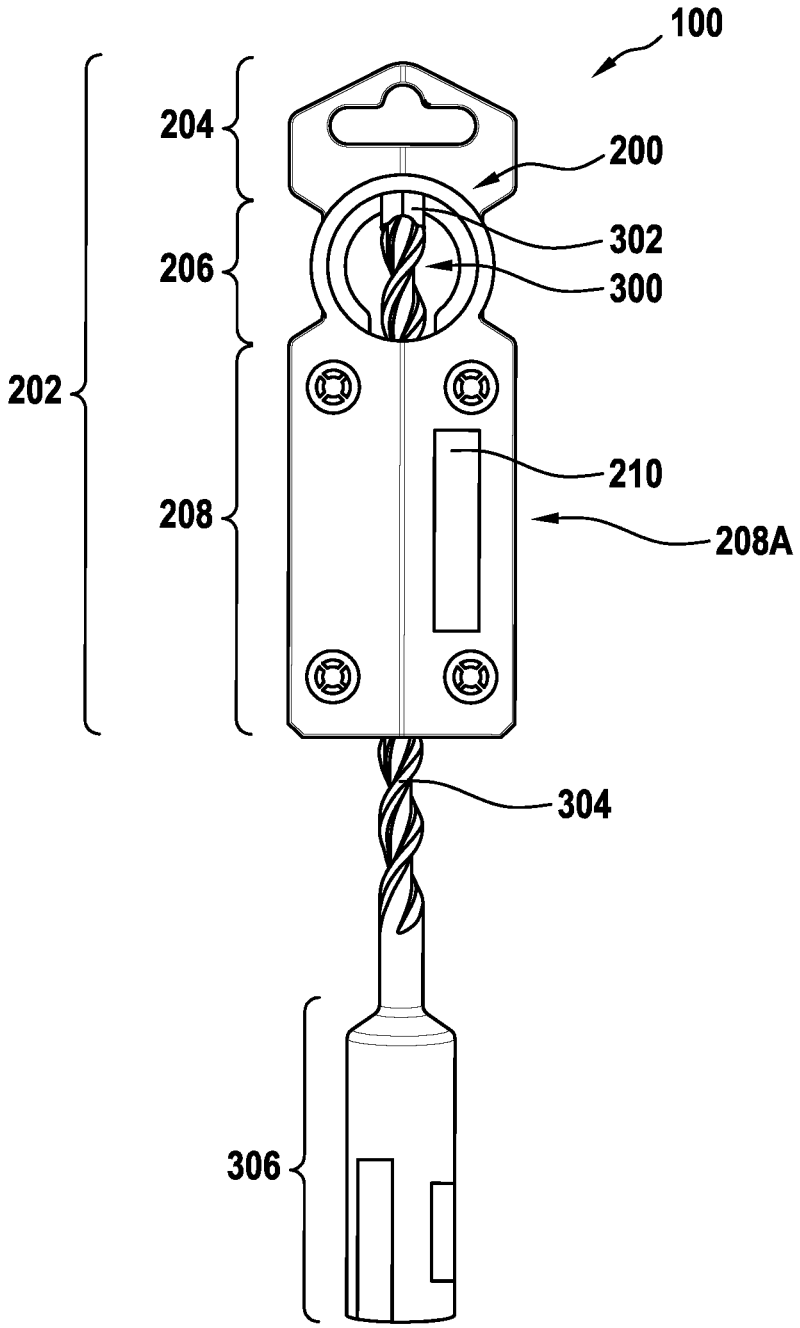
FIG. 1A is a front view of an apparatus according to an example embodiment of this disclosure.
Figure 1B:
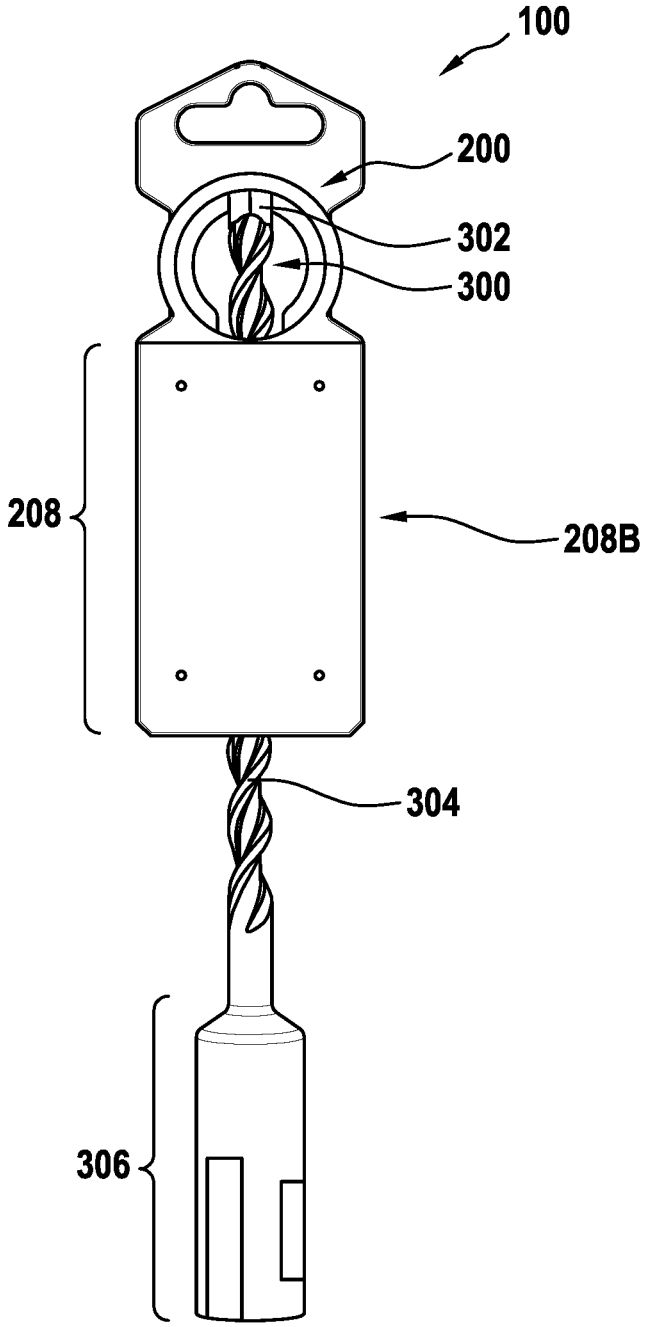
FIG. 1B is a rear view of the apparatus of FIG. 1A according to an example embodiment of this disclosure.

FIGS. 1A-1B are front and rear views of an example embodiment of an apparatus 100 comprising a product display package and an object. More specifically, in this example, the product display package is a hang tag 200 while the object is a drill bit 300. In this regard, the hang tag 200 can be configured for any type of drill bit (e.g., any SDS-plus drill bit, any SDS-max drill bit, or the like) by making adjustments to dimensions of applicable features of the hang tag 200 in accordance with the corresponding features of the selected type of drill bit. However, the apparatus 100 is not limited to this configuration of the hang tag 200 and this type of object, but can include other configurations of the hang tag 200 and other types of objects.

As discussed above, the hang tag 200 is configured to display an object, such as the drill bit 300, by suspending the drill bit 300 with its longitudinal axis extending in a vertical direction. As shown in FIGS. 1A-1B, when suspended, the hang tag 200 is configured to hold the drill bit 300 along its flutes 304 with its cutting edge 302 pointing in an upward direction such that the cutting edge 302 is held above the shank 306 of the drill bit 300. To provide proper support for such an object, the hang tag 200 comprises a suitable material with sufficient rigidity and strength to hold the object. As an example, the hang tag 200 comprises a rigid plastic material, such as a thermoplastic polymer. In an example embodiment, the hang tag 200 comprises acrylonitrile butadiene styrene (ABS). With such a material composition, the hang tag 200 is able to be manufactured with ease via a two-plate molding process.

In an example embodiment, the hang tag 200 includes at least a mounting portion 204, a display portion 206, and a retaining portion 208. In an example embodiment, the retaining portion 208 includes a first retaining part 208A and a second retaining part 208B. In an example embodiment, as shown in FIGS. 1A-1B, the mounting portion 204, the display portion 206, and the first retaining part 208A are connected or integrally formed as a main body 202. In this case, the second retaining part 208B is separate from the first retaining part 208A, but is configured to establish a locking relationship with the first retaining part 208A. With such a configuration, the hang tag 200 is structured to receive and accommodate an object via the display portion 206 and the retaining portion 208.

Figure 2A:
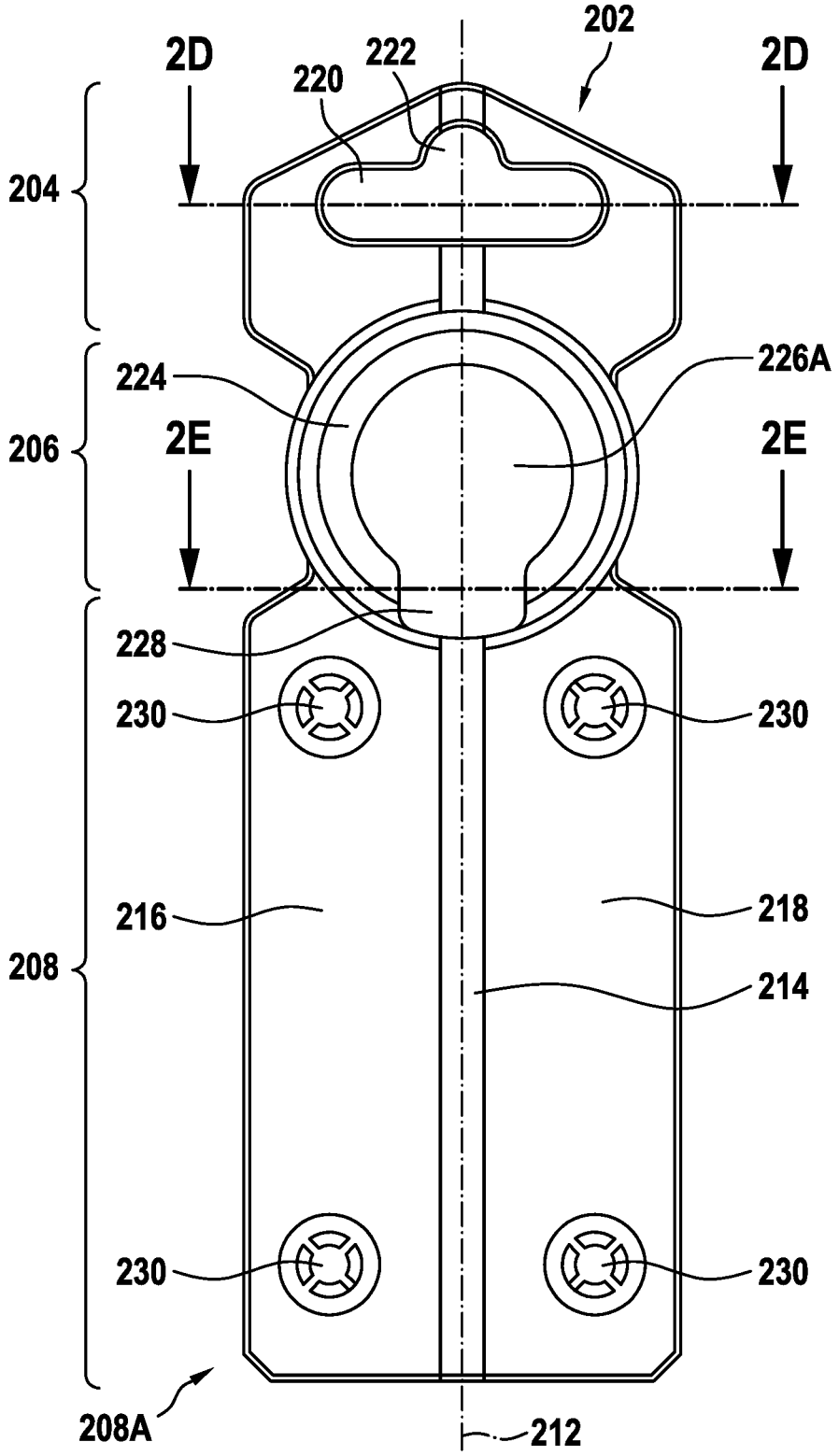
FIG. 2A is a front view of a main body of a hang tag according to an example embodiment of this disclosure.
Figure 2B:
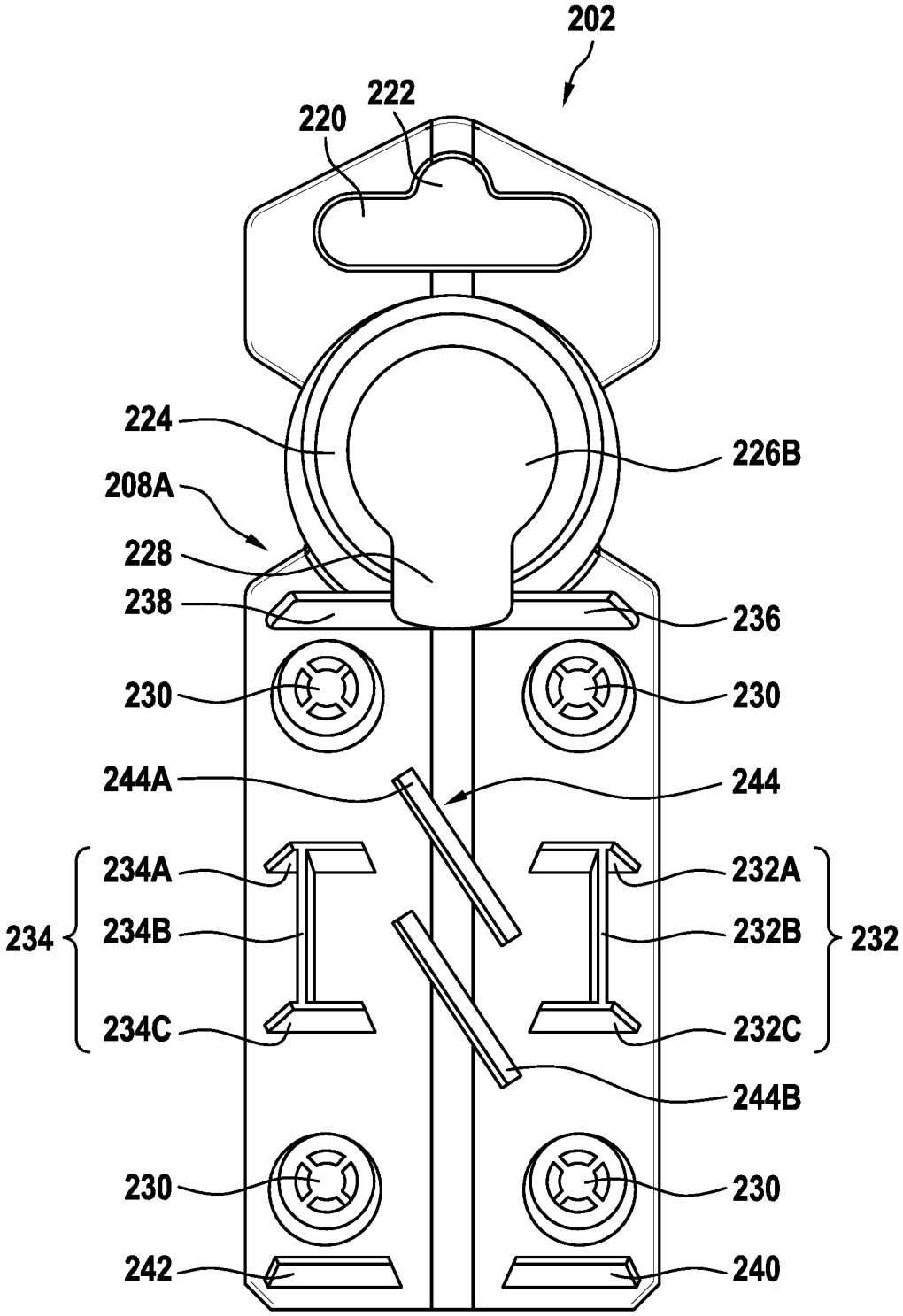
FIG. 2B is a rear view of the main body of FIG. 2A according to an example embodiment of this disclosure.

FIGS. 2A-2E illustrate different views of a main body 202 of the hang tag 200 according to an example embodiment. In an example embodiment, the main body 202 includes a mounting portion 204. In an example embodiment, the mounting portion 204 includes a mounting aperture 220. The mounting aperture 220 is a through-hole, which is configured to receive an element, such as a display rod or hook, from which the hang tag 200 can be hung. In an example embodiment, the mounting aperture 220 is positioned at an upper portion of the hang tag 200. For example, as shown in FIGS. 2A-2B, the mounting aperture 220 is disposed proximate to the uppermost angle of the hang tag 200.

In an example embodiment, the mounting aperture 220 is disposed at or proximate to the axis of symmetry of the hang tag 200. For example, in an example embodiment, the mounting aperture 220 is horizontally centered or substantially horizontally centered on the hang tag 200. In an example embodiment, the mounting aperture 220 is located at a position of the hang tag 200 such that the hang tag 200 is self-centered and upright when hung or mounted on a display rod or hook, the hang tag 200 being upright when its central longitudinal axis 212 is vertical to the ground, with the mounting portion 204 being above the display portion 206 and the retaining portion 208.

In an example embodiment, the shape of the mounting aperture 220 enables the hang tag 200 to self-center in an upright manner when in a hanging state. In this regard, for example, the shape of the mounting aperture 220, as shown in at least FIGS. 2A-2B, includes a hanging notch 222. The shape of mounting aperture 220 can alternatively be any other suitable shape that enables the hang tag 200 to be hung in an upright manner. As another example, the mounting aperture 220 includes a triangular shape.

Figure 2C:
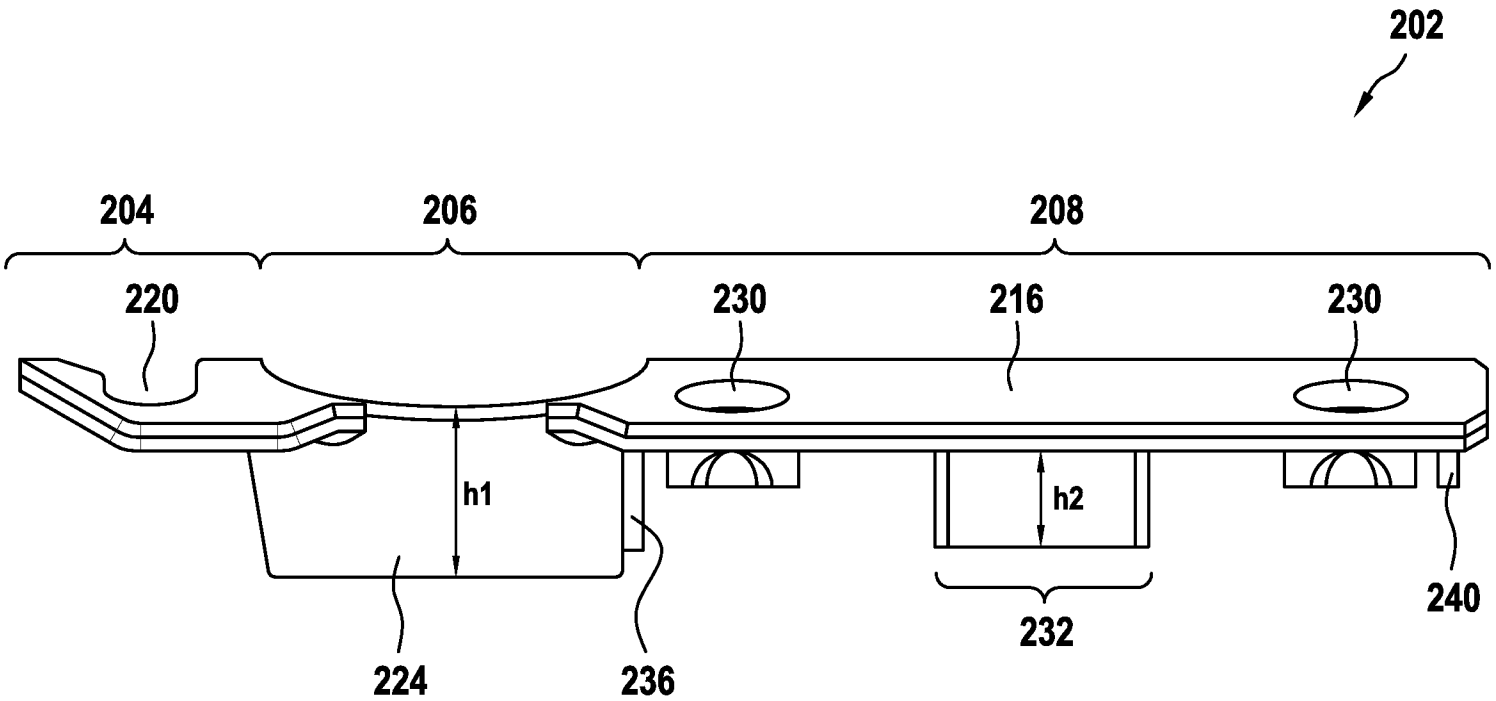
FIG. 2C is a side view of the main body of FIG. 2A according to an example embodiment of this disclosure.
Figure 2D:
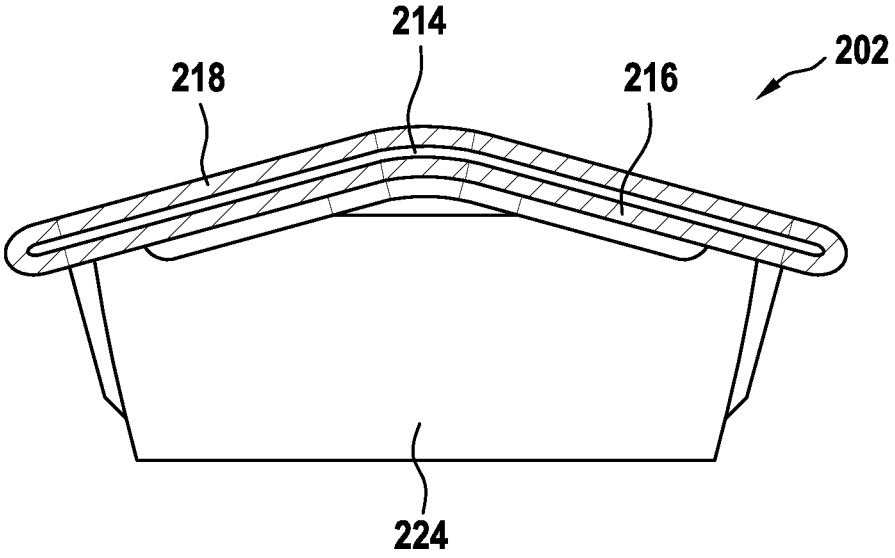
FIG. 2D is a cross-sectional view, taken at line '2D-2D' of FIG. 2A, according to an example embodiment of this disclosure.

In an example embodiment, the main body 202 includes a display portion 206, which is connected to or integral with the mounting portion 204. In an example embodiment, the display portion 206 includes a suitable structure that is configured to house a portion of the object while also providing a view of the object when disposed within the hang tag 200. As shown in FIG. 1A, for instance, the display portion 206 includes a frame structure 224, which is configured to house a portion of the object (e.g., cutting edge portion of the drill bit 300). The frame structure 224 can comprise any suitable shape. In an example embodiment, for instance, the frame structure 224 comprises a cylindrical structure having a height h1 that extends perpendicular to the longitudinal axis 212 of the hang tag 200, as shown in FIGS. 1A and 2C. In an example embodiment, the frame structure 224 is configured to house and frame at least one end portion of the object within its hollow interior region.

In an example embodiment, the display portion 206 includes at least one object viewing region. In this regard, for instance, the object viewing region includes at least one opening, window, or the like. In FIGS. 2A-2B, for example, the object viewing region includes an opening 226A on a front side of the frame structure 224 and an opening 226B on a rear side of the frame structure 224. In addition, in an example embodiment, the display portion 206 includes a notch 228, which is connected to at least the opening 226B. In an example embodiment, the notch 228 provides a clearance in the frame structure 224 for the object. In this regard, the display portion 206 is configured to prominently display at least one end portion of the object when disposed in the hang tag 200.

In an example embodiment, the main body 202 includes a retaining portion 208, which is configured to hold an object between the first retaining part 208A and the second retaining part 208B. In an example embodiment, the first retaining part 208A includes a ridge 214 or ridge-like structure. The ridge 214 or ridge-like structure includes a vertex, which defines a first surface portion 216 and a second surface portion 218. In an example embodiment, as shown in FIGS. 2A-2B, the ridge 214 or ridge-like structure extends along the entire main body 202 and provides the main body 202 with enhanced rigidity and strength. The enhanced rigidity of the main body 202 is particularly beneficial in preventing the hang tag 200 from twisting, flexing, warping, or bending. The hang tag 200 is therefore less prone to damage, which may occur, for example, while boxing and shipping the hang tag 200 and the object received therein to their retail destination.

In addition, the angling of the first surface portion 216 and the second surface portion 218 advantageously provides a wider view angle of a label region, where a label can be applied, compared to that of a flat surface. The label itself can include relevant information about the object held by the hang tag 200. For example, the label can include information such as that relating to the object/product, the retailer, the manufacturer, other types of sales information, or any combination thereof. In an example embodiment, the label region comprises a front side of the first surface portion 216, a front side of the second surface portion 218, or front sides of both the first and second surface portions 214 and 216.

In an example embodiment, on a front side, the first retaining part 208A includes a recess portion 210 in which a security device/tag can be disposed. As shown in FIG. 1A, the recess portion 210 is configured to extend in a longitudinal direction on one side of the ridge 214, with the recess portion 210 being disposed in its entirety in the second surface portion 218 of the hang tag 200. In an alternative example embodiment, the recess portion 210 is disposed in its entirety in the first surface portion 216 of the hang tag 200. In this example embodiment, the recess portion 210 does not overlap the vertex of the ridge 214, but remains on a single surface portion (e.g., only the second surface portion 218) of the hang tag 200. The positioning of the recess portion 210 ensures that a security device, which is positioned therein, experiences less disruption in the event that the hang tag 200 is, for example, flexed along a horizontal axis.

In an example embodiment, the recess portion 210 is configured to receive a security sensor, a security tag, or any suitable security device, which is traceable and/or deters theft. As a non-limiting example, the security tag is a Sensormatic® tag. In this regard, the recess portion 210 is sized such that an appropriate security device is able to be held therein. Additionally or alternatively, in an example embodiment, a depth of the recess portion 210 is such that the security device is substantially flush or below a surface of the surface portion (e.g., second surface portion 218). By providing a recess portion 210 in this manner, i.e., such that the security device does not protrude from a surface of the main body 202, the hang tag 200 is able to advantageously include a security device that is concealed from an individual's view (e.g., a shopper's view) when a label is placed in the label region and overlays the recess portion 210. In such a scenario, the concealment of the security device is advantageous, as it prevents the security device from being removed from the hang tag 200.

In an example embodiment, as aforementioned, the first retaining part 208A is configured to mate with the second retaining part 208B. In addition, the first retaining part 208A is configured to establish a locking relationship with the second retaining part 208B. In this regard, the first retaining part 208A includes a first mating component, which is configured to mate with a second mating component of the second retaining part 208B. Alternatively, in an example embodiment, these mating components can be reversed or combined in different configurations on the first and second retaining parts 208A and 208B so long as they are able to establish the requisite locking relationship between the first retaining part 208A and the second retaining part 208B.

Figure 3A:
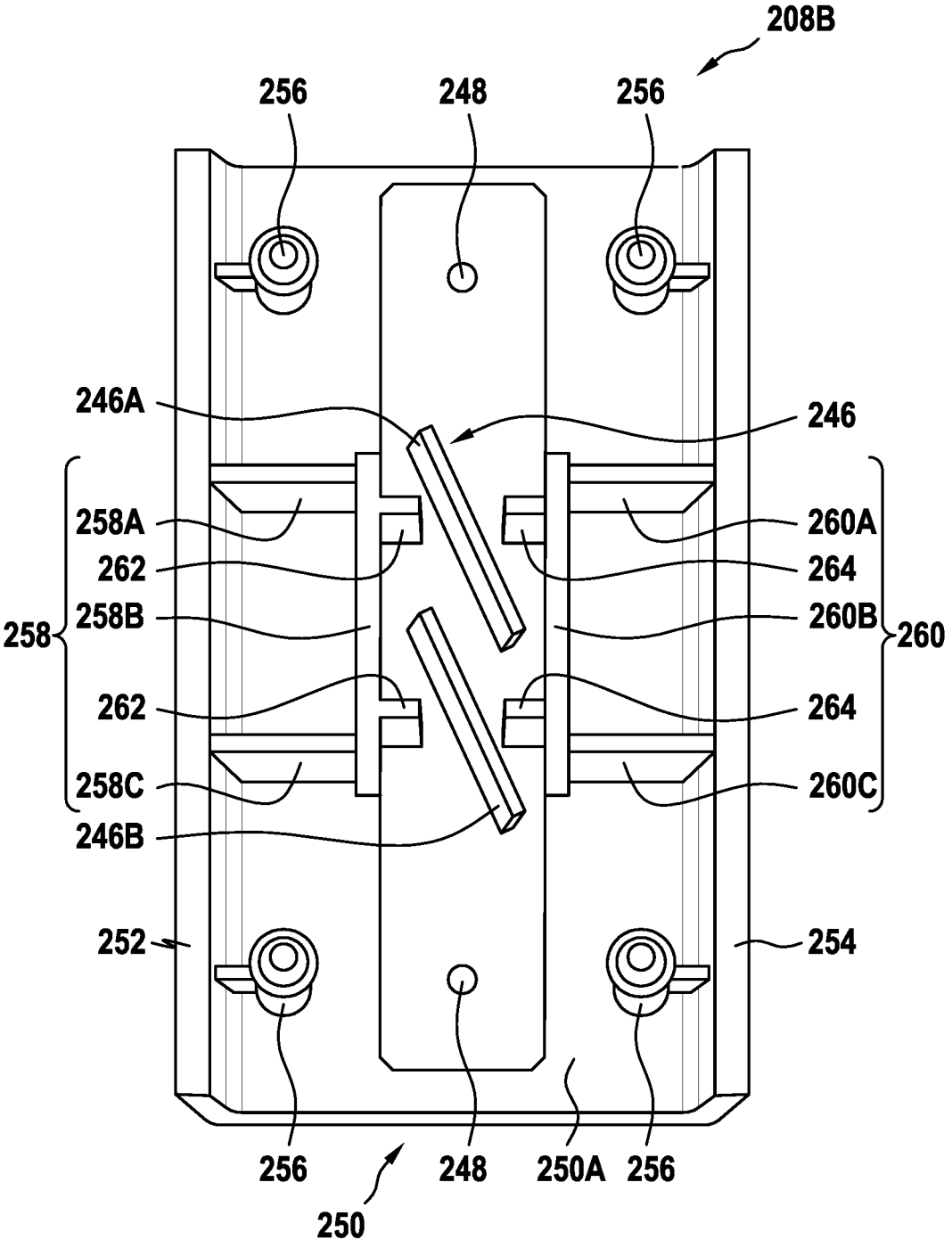
FIG. 3A is a front view of a second retaining part of a hang tag according to an example embodiment of this disclosure.

In an example embodiment, as shown in FIG. 2A, for instance, the first retaining part 208A includes tapered holes 230, as the first mating component (FIG. 2A), while the second retaining part 208B includes locking pins 256, as the second mating component (FIG. 3A). In an example embodiment, the tapered holes 230 are tapered in a manner that establishes a locking relationship with tapered knob-like portions on an upper part of the locking pins 256. In an example embodiment, the first and second mating components are positioned at suitable locations of the retaining portion 208 such that the first and second retaining parts 208A and 208B are securely held together when united. In FIGS. 2A-2B, for instance, the tapered holes 230 are positioned at corner regions of the first retaining part 208A. Meanwhile, as shown in FIG. 3A, the locking pins 256 are positioned at corresponding corner regions of the second retaining part 208B that align with the tapered holes 230. Accordingly, with at least these mating components, the first retaining part 208A is configured to establish a locking relationship with the second retaining part 208B, thereby enabling an object to be securely held in the hang tag 200 between the first retaining part 208A and the second retaining part 208B.

In an example embodiment, the first retaining part 208A includes other mating components, which connect the first retaining part 208A to the second retaining part 208B. In FIG. 2B, for instance, on a rear side, the first retaining part 208A includes a first connecting member 232 and a second connecting member 234. In this regard, for example, the first connecting member 232 of the first retaining part 208A is configured to connect to a first connecting unit 258 of the second retaining part 208B while the second connecting member 234 of the first retaining part 208A is configured to connect to a second connecting unit 260 of the second retaining part 208B. Alternatively, in an example embodiment, these connecting components can be reversed or combined in different configurations on the first and second retaining parts 208A and 208B so long as they are able to establish the requisite connections between the first retaining part 208A and the second retaining part 208B. Accordingly, with these connections, the first retaining part 208A is configured to connect to the second retaining part 208B.

In an example embodiment, the first connecting member 232 includes any suitable structure that is configured to mate and connect with the first connecting unit 258. For instance, as a non-limiting example, the first connecting member 232 includes a three-sided structure, as shown in FIG. 2B. In an example embodiment, the first connecting member 232 includes a first wall 232A, a second wall 232B, and a third wall 232C, which are connected or integrally formed. In an example embodiment, the first connecting member 232 has a height h2 that is less than a height h1 of the frame structure 224, as shown in FIG. 2C. Also, the height h2 of the first connecting member 232 is greater than at least one dimension of the object (e.g., a diameter of the drill bit 300). In an example embodiment, the first connecting member 232 is configured to be received within the bounds of the first connecting unit 258. In this regard, the first connecting member 232 is configured to fit within a space provided by an interior region of the first connecting unit 258, thereby connecting the first connecting member 232 to the first connecting unit 258.

In an example embodiment, the second connecting member 234 includes any suitable structure that is configured to mate and connect with the second connecting unit 260. For instance, as a non-limiting example, the second connecting member 234 includes a three-sided structure, as shown in FIG. 2B. In an example embodiment, the second connecting member 234 includes a first wall 234A, a second wall 234B, and a third wall 234C, which are connected or integrally formed. In an example embodiment, the second connecting member 234 also has a height h2 that is less than a height h1 of the frame structure 224. Also, the height h2 of the second connecting member 234 is greater than at least one dimension of the object (e.g., a diameter of the drill bit 300). In an example embodiment, the second connecting member 234 is configured to be received within the bounds of the second connecting unit 260. In this regard, the second connecting member 234 is configured to fit within a space provided by an interior region of the second connecting unit 260, thereby connecting the second connecting member 234 to the second connecting unit 260.

In an example embodiment, the retaining portion 208 includes sidewalls, which enclose sides of the retaining portion 208 while providing clearance at appropriate locations for the object. In this regard, the retaining portion 208 can include these sidewalls on the first retaining portion 208A, the second retaining portion 208, or a combination thereof. For instance, in an example embodiment, the first retaining part 208A includes sidewall 236, sidewall 238, sidewall 240, and sidewall 242, as shown in FIG. 2B, while the second retaining part 208B includes sidewall 252 and sidewall 254, as shown in FIG. 3A. When the first retaining part 208A is secured to the second retaining part 208B, the sidewalls 236, 238, 240, 242, 252, and 254 enclose the sides of the retaining portion 208 except at portions, where the object is to reside.

In an example embodiment, as shown in FIG. 2B, the sidewall 236 and the sidewall 238 extend outward from a rear side of the first retaining part 208A. In an example embodiment, the sidewall 236 and the sidewall 238 are spaced apart from each other by an appropriate distance along a horizontal axis such that sufficient clearance is provided for the object. In FIG. 2B, for instance, the sidewall 236 and the sidewall 238 are adjacent to the notch 228 and provide a clearance that is sized similar to or substantially similar to the opening in the frame structure 224 that is provided by the notch 228. Moreover, when the hang tag 200 is suspended, the sidewall 236 and the sidewall 238 are structured to cover an upper part of the retaining portion 208 and protect an interior region of the retaining portion 208.

In an example embodiment, as shown in FIG. 2B, the sidewall 240 and the sidewall 242 are provided on a rear side of the first retaining part 208A. In an example embodiment, the sidewall 240 and the sidewall 242 are spaced apart from each other by an appropriate distance such that sufficient clearance is provided for the object. In FIG. 2B, for instance, the sidewall 240 and the sidewall 242 provide a clearance that is sized similar to or substantially similar to the clearance that is provided between the sidewall 236 and the sidewall 238. In addition, the sidewall 240 and the sidewall 242 provide a barrier that protects an interior region of the retaining portion 208.

Figure 2E:
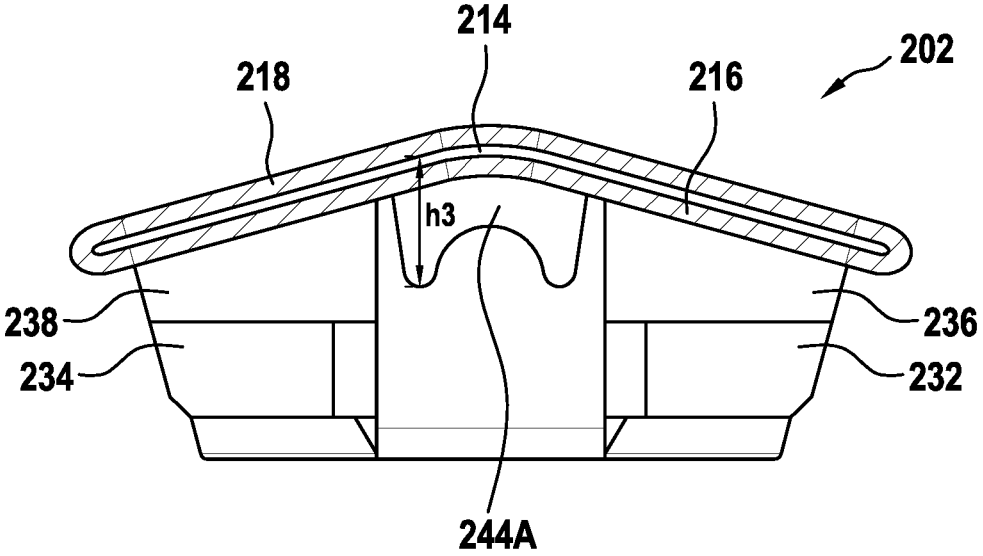
FIG. 2E is a cross-sectional view, taken at line '2E-2E' of FIG. 2A, according to an example embodiment of this disclosure.

In an example embodiment, the retaining portion 208 includes a first holding portion 244 with at least one rib that is configured to engage the object. In an example embodiment, as shown in FIG. 2B, for instance, the first holding portion 244 includes a first set of ribs. In this example, the first set of ribs includes at least a first rib 244A and a second rib 244B. In an example embodiment, each rib of the first set of ribs has a height h3 that is less than a height h2 of the first connecting member 232 or a height h2 of the second connecting member 234, as shown in FIG. 2E.

In an example embodiment, when the object is a drill bit 300, the first rib 244A and the second rib 244B are oriented at an angle with respect to a center longitudinal axis 212 of the hang tag 200 such that the first rib 244A and the second rib 244B are structured to engage or interact with flutes 304 of the drill bit 300. In an example embodiment, each of the first and second ribs 244A and 244B has a curved surface that engages with and corresponds to a curvature of a respective flute of the drill bit 300. In this regard, for instance, FIG. 2E illustrates a view of a curved surface of at least the first rib 244A. Although not shown, the second rib 244B has a curved surface that is similar to or substantially similar to the curved surface of the first rib 244A. In this case, due to the body shape of the drill bit 300, each curved surface is configured to provide a more secure hold of the drill bit 300 than a flat surface. In addition, the spacing between the first rib 244A and the second rib 244B is similar to a spacing provided between different flutes 304 of the drill bit 300. Also, in this example, the first rib 244A and the second rib 244B are parallel or substantially parallel to each other. In this regard, the first rib 244A and the second rib 244B are configured to lock into contours of the flutes 304 of the drill bit 300, thereby preventing a movement (e.g., rotational movement, longitudinal movement, etc.) of the drill bit 300. With this arrangement and configuration, the first set of ribs is configured to ensure that the drill bit 300 is aligned and held in a secure manner by at least the first retaining part 208A of the retaining portion 208.

FIGS. 3A-3E illustrate different views of the second retaining part 208B according to an example embodiment. In an example embodiment, for instance, on a front side, the second retaining part 208B includes a second holding portion 246 with at least one rib that is configured to engage with the object. In an example embodiment, as shown in FIG. 3A, for instance, the second holding portion 246 includes a second set of ribs. In this example, the second set of ribs includes at least a first rib 246A and a second rib 246B. In an example embodiment, each rib of the second set of ribs has a height h4 that is less than a height h5 of the first connecting unit 258 or a height h5 of the second connecting unit 260.

Figure 3B:
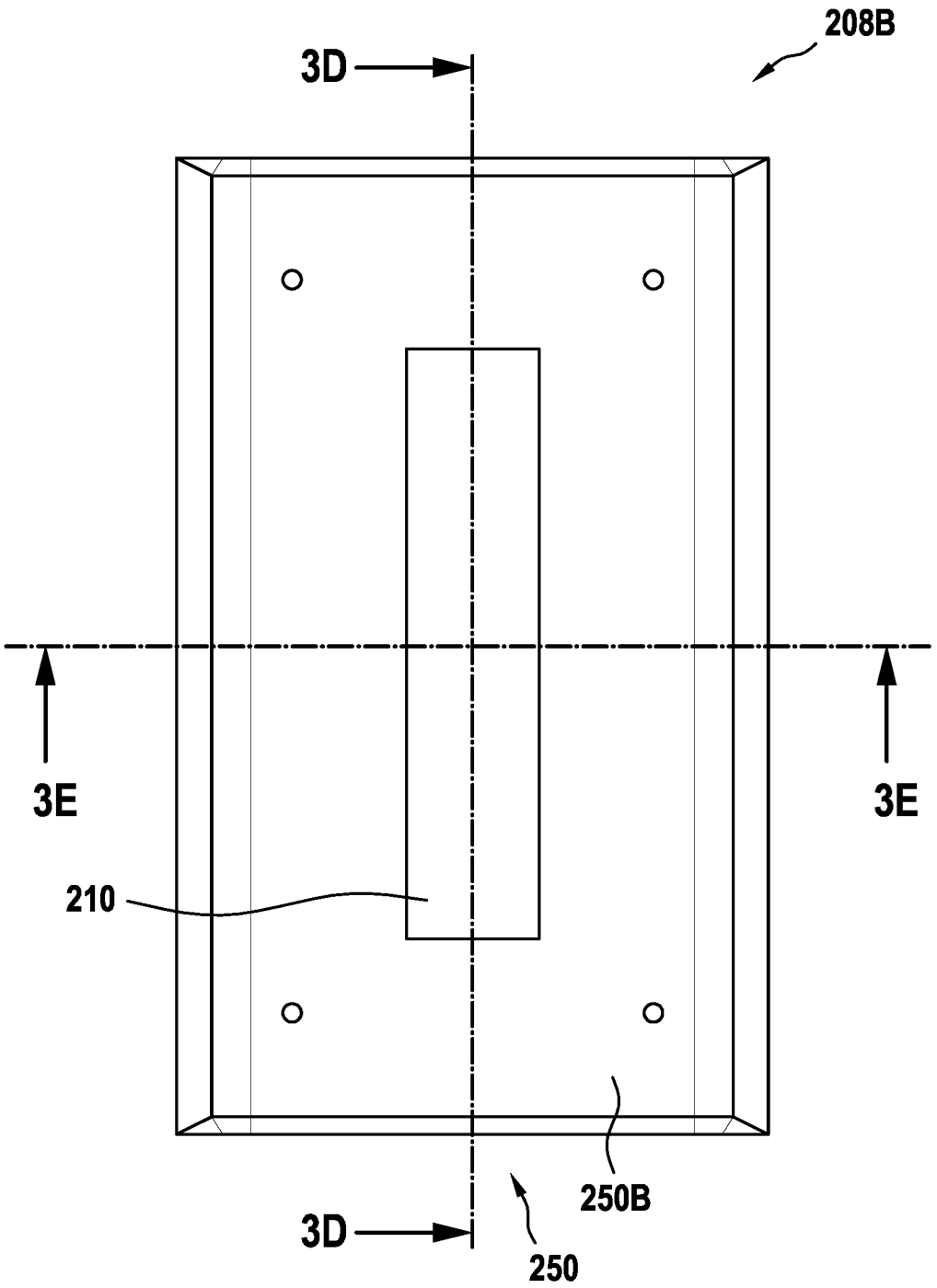
FIG. 3B is a rear view of the second retaining part of FIG. 3A according to an example embodiment of this disclosure.
Figure 3C:
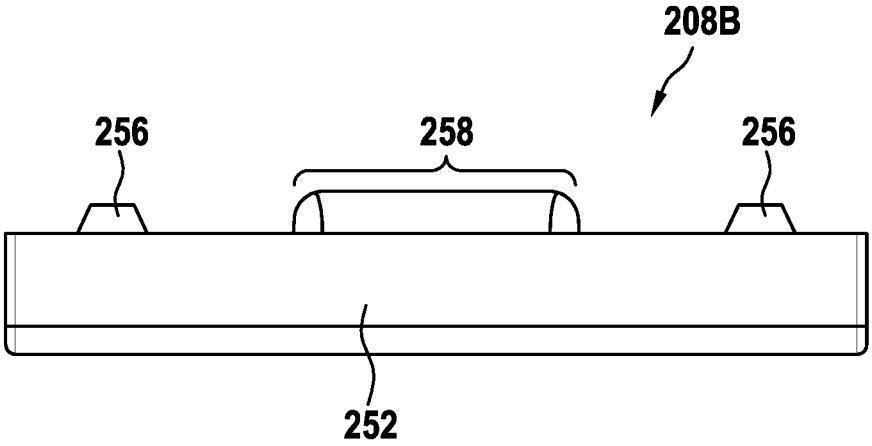
FIG. 3C is a side view of the second retaining part of FIG. 3A according to an example embodiment of this disclosure.
Figure 3D:
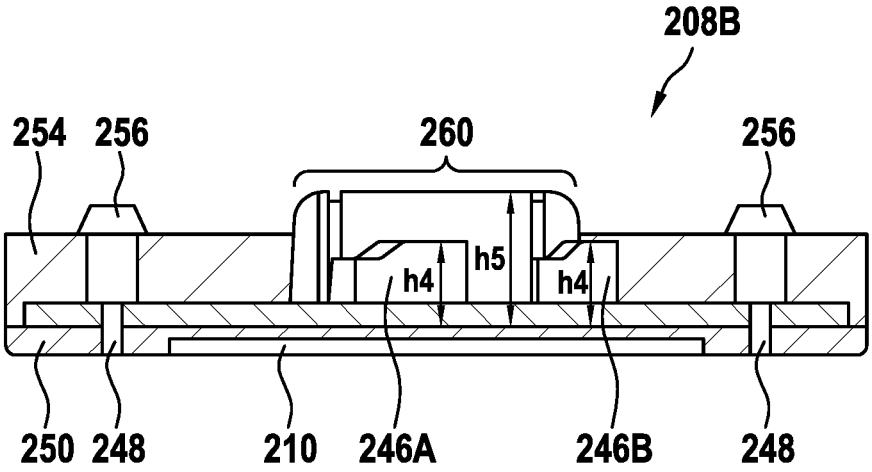
FIG. 3D is a cross-sectional view, taken at line '3D-3D' of FIG. 3B, according to an example embodiment of this disclosure.
Figure 3E:
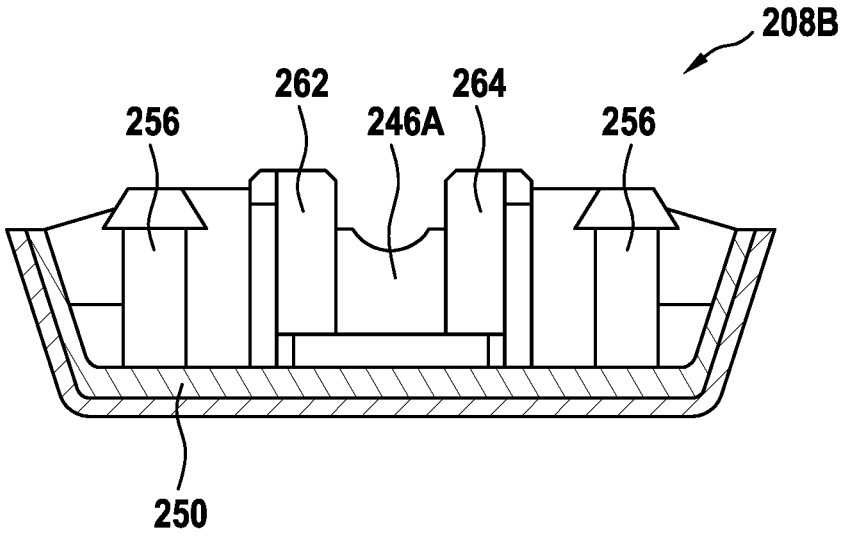
FIG. 3E is a cross-sectional view, taken at line '3E-3E' of FIG. 3B, according to an example embodiment of this disclosure.

In an example embodiment, when the object is a drill bit 300, the first rib 246A and the second rib 246B are oriented at an angle with respect to a center longitudinal axis 212 of the hang tag 200 such that the first rib 246A and the second rib 246B are structured to engage or interact with flutes 304 of the drill bit 300. In an example embodiment, each of the first and second ribs 246A and 246B has a curved surface that engages with and corresponds to a curvature of a respective flute of the drill bit 300. In this regard, for instance, FIG. 3E illustrates a view of a curved surface of at least the first rib 246A. Although not shown, the second rib 246B has a curved surface that is similar to or substantially similar to the curved surface of the first rib 246A. In this case, due to the body shape of the drill bit 300, each curved surface is configured to provide a more secure hold of the drill bit 300 than a flat surface. In addition, the spacing between the first rib 246A and the second rib 246B is similar to a spacing provided between different flutes 304 of the drill bit 300. Also, in this example, the first rib 246A and the second rib 246B are parallel or substantially parallel to each other. In this regard, the first rib 246A and the second rib 246B are configured to lock into contours of the flutes 304 of the drill bit 300, thereby preventing a movement (e.g., rotational movement, longitudinal movement, etc.) of the drill bit 300. With this arrangement and configuration, the second set of ribs is configured to ensure that the drill bit 300 is aligned and held in a secure manner by at least the second retaining part 208B of the retaining portion 208.

In an example embodiment, the retaining portion 208 includes at least one fastener 248, which is configured to fasten an insert 400 to the hang tag 200 such that the insert 400 engages with the object. As a non-limiting example, the fastener 248 is a pin or any suitable mechanical device. For instance, in FIG. 3A, the second retaining part 208B includes at least one fastener 248 at one end of the second set of ribs and at least one other fastener 248 at an opposite end of the second set of ribs. In this example, these fasteners 248 are configured to hold the insert 400 over the second set of ribs. With this arrangement, the insert 400 is positioned between the object, when disposed in the hang tag 200, and the second set of ribs. In this regard, the insert 400 is configured to compress and prevent the object, when disposed in the hang tag 200, from moving within the hang tag 200. Alternatively, the retaining portion 208 can include at least one fastener 248 for the insert 400 at other suitable locations such that the insert 400 is held into a position in which the insert 400 is able to engage with the object and prevent a movement of the object. For instance, in an alternative example embodiment (not shown), the retaining portion 208 can include at least one fastener 248 on a rear side of the first retaining part 208A such that the insert 400 is fastened over the first set of ribs and positioned between the object, when disposed in the hang tag 200, and the first set of ribs.

In an example embodiment, as discussed above, the retaining portion 208 includes sidewalls, which enclose sides of the retaining portion 208 while providing clearance at appropriate locations for the object. In an example embodiment, for instance, the first retaining part 208A includes sidewall 236, sidewall 238, sidewall 240, and sidewall 242, as shown in FIG. 2B, and the second retaining part 208B includes sidewall 252 and sidewall 254, as shown in FIG. 3A. More specifically, with regard to the second retaining part 208B, the sidewall 252 and the sidewall 254 are positioned on opposite sides of a center section 250 of the second retaining part 208B. In an example embodiment, each of the sidewalls 252 and 254 projects upward from a first surface 250A of the center section 250 and extends along an entire length of the second retaining part 208B. In an example embodiment, the sidewall 252 and the sidewall 254 are structured to cover the lateral sides of the retaining portion 208 and provide a barrier that protects an interior region of the retaining portion 208.

In an example embodiment, as discussed above, the second retaining part 208B is configured to mate with the first retaining part 208A. In this regard, for instance, the second retaining part 208B can include a second mating component that is configured to mate with a first mating component of the first retaining part 208A. As one example, the second retaining part 208B can include locking pins 256, as the second mating component (FIG. 3A), while the first retaining part 208A can include tapered holes 230, as the first mating component (FIGS. 2A-2B). More specifically, the locking pins 256 are positioned on the second retaining part 208 such that the locking pins 256 are aligned with the tapered holes 230 of the first retaining part 260A. In FIG. 3A, for example, the locking pins 256 are positioned at corner regions of the first surface 250A of the center section 250 of the second retaining part 208B. Accordingly, with at least these mating components, the second retaining part 208B is configured to establish a locking relationship with the first retaining part 208A.

In an example embodiment, the second retaining part 208B can include other mating components, which connect the second retaining part 208B to the first retaining part 208A. In FIG. 3A, for instance, on a front side, the second retaining part 208B includes a first connecting unit 258 and a second connecting unit 260 on the first surface 250A. As previously discussed, in an example embodiment, the first connecting unit 258 is configured to connect to the first connecting member 232 of the first retaining part 208A and the second connecting unit 260 is configured to connect to a second connecting member 234 of the second retaining part 208B.

In an example embodiment, the first connecting unit 258 includes any suitable structure that is configured to mate with the first connecting member 232. In an example embodiment, the first connecting unit 258 is configured as a receiving slot structure. For instance, as a non-limiting example, the first connecting unit 258 includes a first wall 258A, a second wall 258B, a third wall 258C, and a corresponding portion of the sidewall 252, as shown in FIG. 3A. In this regard, the first connecting unit 258 is configured to receive the first connecting member 232 within an interior space of the first connecting unit 258. That is, the first connecting unit 258 is configured to mate with and connect to the first connecting member 232, thereby aligning the first and second retaining parts 208A and 208B to each other.

In an example embodiment, the second connecting unit 260 includes any suitable structure that is configured to mate with the second connecting member 234. In an example embodiment, the second connecting unit 260 is configured as a receiving slot structure. For instance, as a non-limiting example, the second connecting unit 260 includes a first wall 260A, a second wall 260B, a third wall 260C, and a corresponding portion of the sidewall 254, as shown in FIG. 3A. In this regard, the second connecting unit 260 is configured to receive the second connecting member 234 within an interior space of the second connecting unit 260. That is, the second connecting unit 260 is configured to mate with and connect to the first connecting member 234, thereby aligning the first and second retaining parts 208A and 208B to each other.

In an example embodiment, on a front side, the second retaining part 208B includes a first supporting structure with at least one protrusion 262, which extends from a surface of the second wall 258B that faces the object. In FIG. 3A, for instance, the first supporting structure includes two protrusions 262, which are spaced apart from each other along the surface of the second wall 258B. In addition, the two protrusions 262 are parallel to each other and extend along a horizontal axis, which is perpendicular to the longitudinal axis 212.

In an example embodiment, on a front side, the second retaining part 208B includes a second supporting structure with at least one protrusion 264, which extends from a surface of the second wall 260B that faces the object. In FIG. 3A, for instance, the second supporting structure includes two protrusions 264, which are spaced apart from each other along the surface of the second wall 260B. In addition, the two protrusions 264 are parallel to each other and extend along a horizontal axis, which is perpendicular to the longitudinal axis 212.

In an example embodiment, each protrusion 262 is aligned with a corresponding protrusion 264, as shown in FIG. 3A. Also, in an example embodiment, each protrusion 262 is spaced from its corresponding protrusion 264 along a horizontal axis. In an example embodiment, this space, between each protrusion 262 with its corresponding protrusion 264, provides room for the object to reside. In this regard, for instance, to accommodate the object, the first rib 246A has a section that extends within the space between one of the protrusions 262 and its corresponding protrusion 264. In addition, the second rib 246B has a section that extends within the space between the other protrusion 262 and its corresponding protrusion 264. Accordingly, with such a configuration, the first supporting structure with the protrusions 262 and the second supporting structure with the protrusions 264 are configured to prevent a movement of the object when disposed within the hang tag 200.

In an example embodiment, on a rear side, the second retaining part 208B includes a recess portion 210. More specifically, in an example embodiment, the recess portion 210 is provided on a second surface 250B of the center section 250 of the second retaining part 208B, as shown in FIG. 3B. In an example embodiment, the recess portion 210 is configured to receive a security sensor, a security tag, or any suitable security device, which is traceable and/or deters theft. As discussed previously, the recess portion 210 is sized such that an appropriate security device is able to be held therein. Additionally or alternatively, in an example embodiment, a depth of the recess portion 210 is such that the security device is substantially flush or below the second surface 250B. By providing a recess portion 210 in this manner, i.e., such that the security device does not protrude from the second surface 250B, the hang tag 200 is able to advantageously include a security device that is concealed from an individual's view (e.g., a shopper's view) when a rear label is placed over the second surface 250B and overlays the recess portion 210. In such a scenario, the concealment of the security device is advantageous, as it prevents the security device from being removed from the hang tag 200.

Figure 4A:
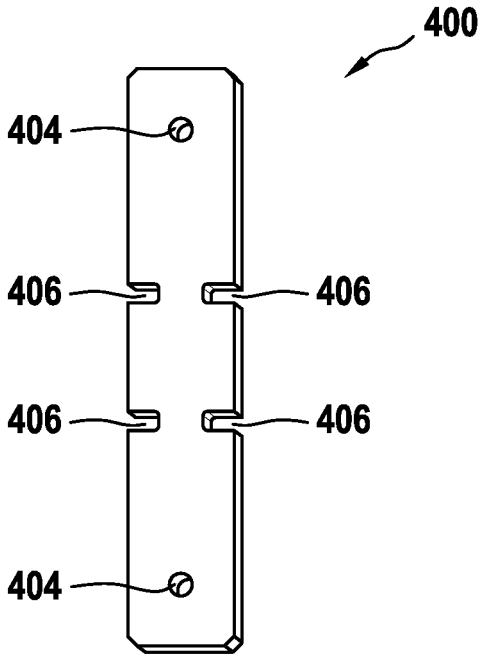
FIG. 4A is an illustration of an example of an insert for a hang tag according to an example embodiment of this disclosure.

FIG. 4A illustrates one example of an insert 400 according to an example embodiment. In an example embodiment, the insert 400 comprises a compressible material. In an example embodiment, the insert 400 is also flexible and lightweight. As a non-limiting example, the insert 400 comprises a rubber material (e.g., thermoplastic elastomers or the like) or any suitable material. In this regard, the insert 400 is configured to compress and prevent a movement of the object when disposed within the hang tag 200.

In an example embodiment, the insert 400 includes at least one structure, which is configured to connect to the hang tag 200. In FIG. 4A, for instance, the insert 400 includes through holes 404, which are configured to mate with corresponding fasteners 248 of the hang tag 200. This connection ensures that the insert 400 is held in place and does not move within the hang tag 200.

In an example embodiment, the insert 400 is structured to provide at least a compressive force between the object and the hang tag 200. In this regard, to engage with the object, the insert 400 is structured to fit, complement, or correspond to the structure provided by the retaining portion 208. As shown in FIG. 4A, for instance, the insert 400 includes slits 406, which are positioned along side edges of the insert 400 to correspond to and mate with the protrusions 262 and 264 of the hang tag 200. In this example, the protrusions 262 and 264 are configured to pass through the slits 406 and prevent the insert 400 from moving within the hang tag 200.

In an example embodiment, the insert 400 is structured to cover at least one of the holding portions (e.g., the second holding portion 246) such that the insert 400 is positioned at least between one set of ribs (e.g., the second set of ribs) and the object. Alternatively, in another example embodiment (not shown), the first retaining part 208A can include at least one fastener 248 so that the insert 400 can be positioned to cover at least the first holding portion 244 of the first retaining part 208A. In each of these cases, the insert 400 provides a compressible surface for the object that prevents the object from moving within the hang tag 200.

Figure 4B:
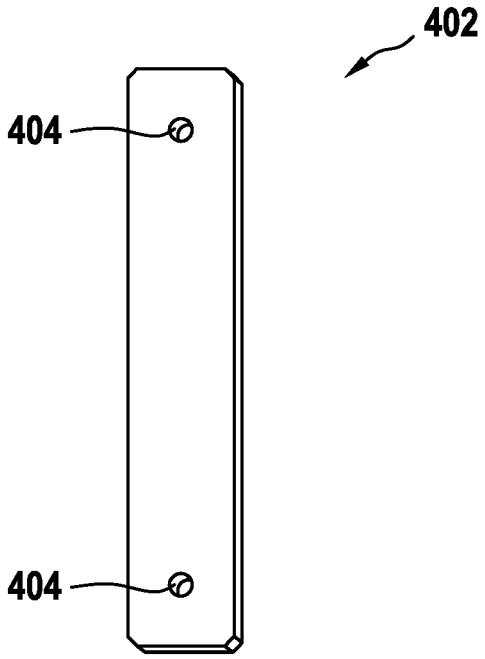
FIG. 4B is an illustration of another example of an insert for a hang tag according to an example embodiment of this disclosure.

FIG. 4B illustrates an example of an insert 402 according to an alternative example embodiment. More specifically, the insert 402 of FIG. 4B includes a number of similar or substantially similar features, as described above with respect to the insert 400 of FIG. 4A. In this regard, for instance, the insert 402 comprises the same material composition and properties as the insert 400. In addition, the insert 402 includes through holes 404, which are configured to mate with corresponding fasteners 248 or any suitable structure. However, unlike the insert 400 of FIG. 4A, the insert 402 does not include slits 406. In this alternative embodiment, the insert 402 can be applied to a retaining portion 208 that does not include protrusions 262 and 264, as shown in FIGS. 5A and 5B.

Figure 5A:
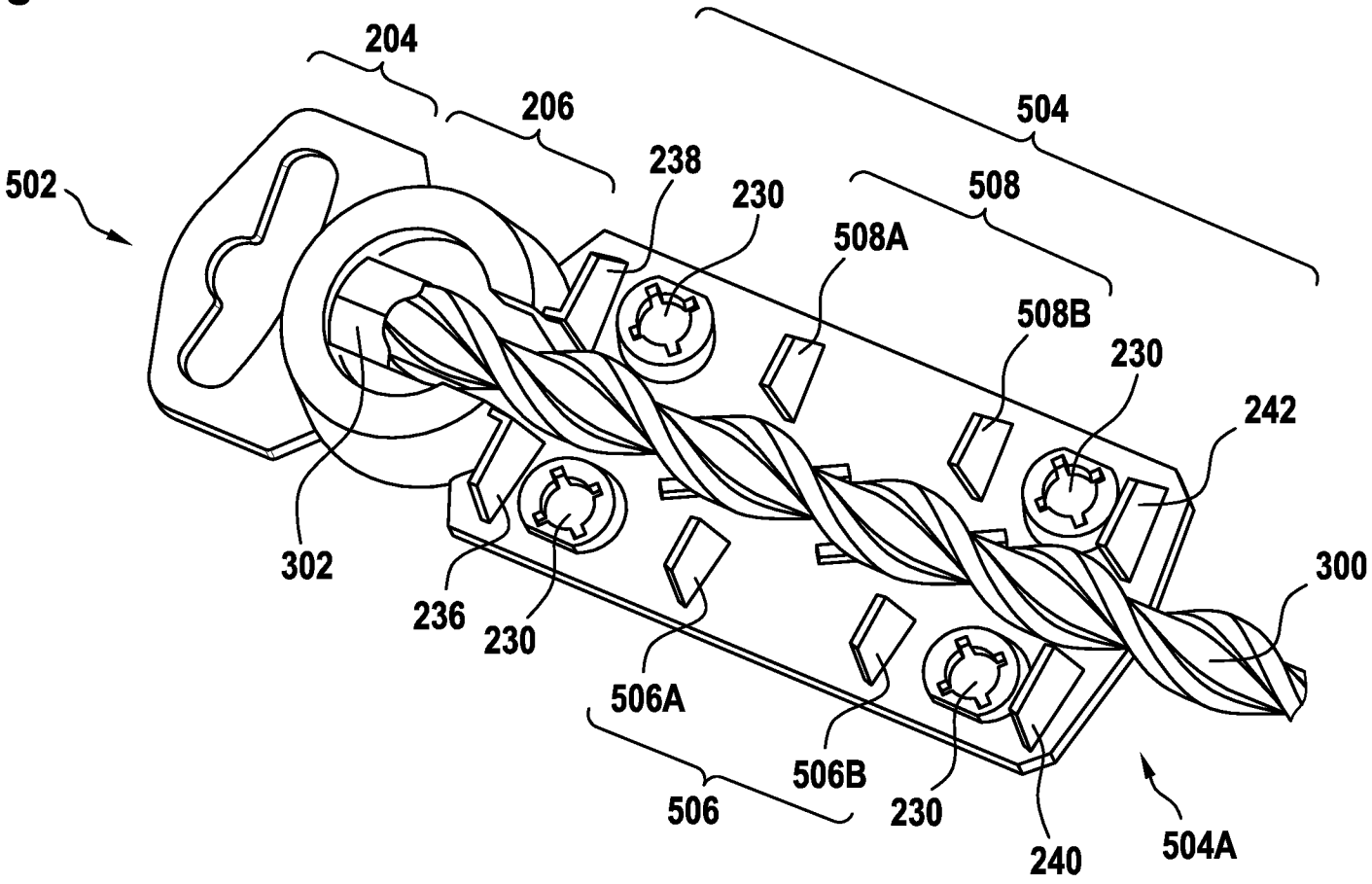
FIG. 5A is an example of a main body including a first retaining part together with an object according to an alternative example embodiment of this disclosure.
Figure 5B:
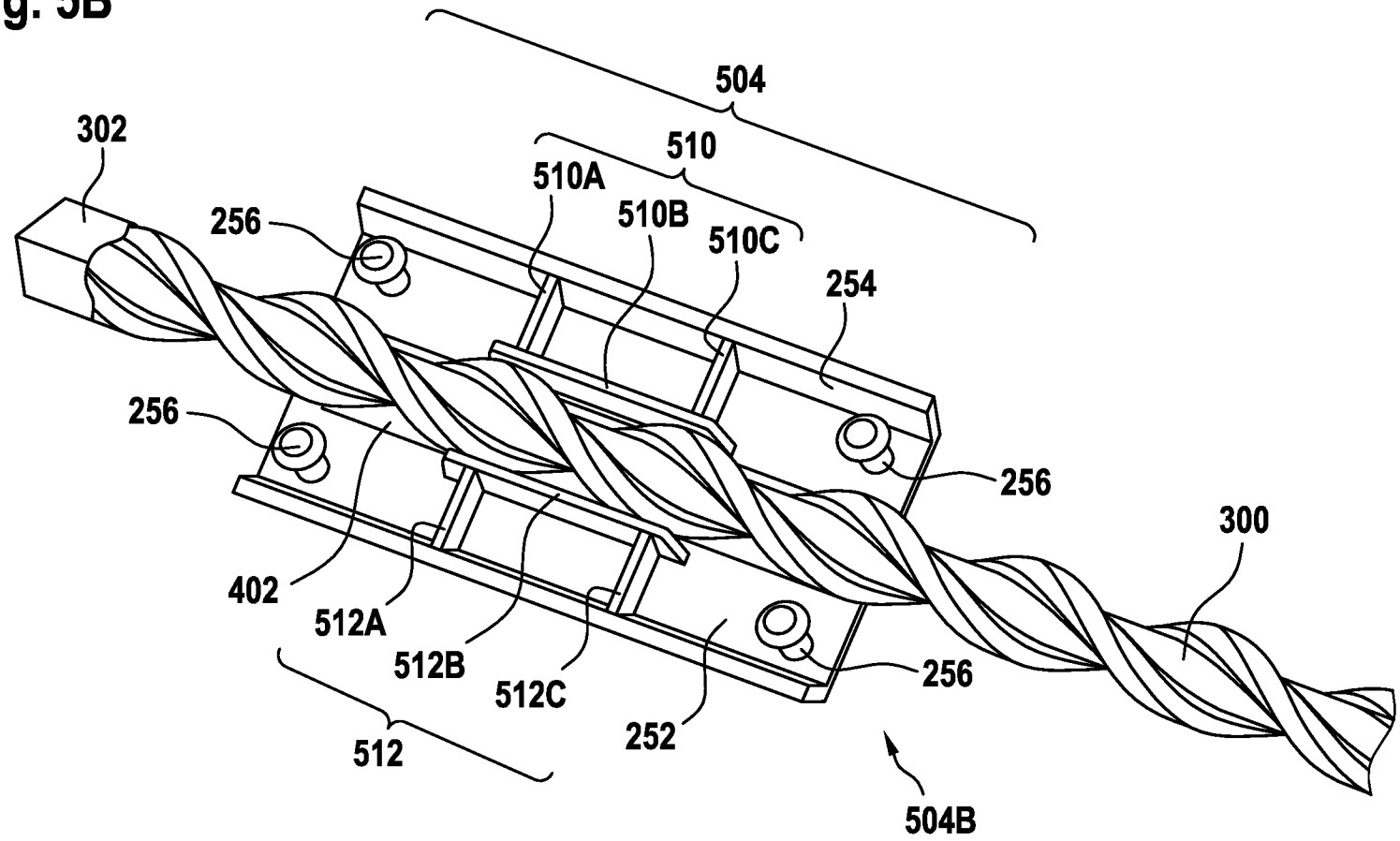
FIG. 5B is an example of the second retaining part of the hang tag of FIG. 5A together with the object according to an alternative example embodiment of this disclosure.

FIGS. 5A-5B illustrate an alternative example embodiment of a hang tag 200 together with an object, such as a drill bit 300. More specifically, FIG. 5A illustrates an example of a main body 502. In an example embodiment, the main body 502 includes a number of similar or substantially similar features as that described above with respect to the main body 202 of FIGS. 2A-2B. For instance, the main body 502 includes a mounting portion 204 and a display portion 206. However, unlike the main body 202 of FIGS. 2A-2B, the main body 502 includes a first retaining part 504A with a first connecting member 506 and a second connecting member 508. In this example, the first connecting member 506A includes a first projecting member 506A and a second projecting member 506B. Also, in this example, the second connecting member 508A includes a first projecting member 508A and a second projecting member 508B.

In an example embodiment, the first connecting member 506 is configured to connect to and/or mate with the first connecting unit 510. Meanwhile, the second connecting member 508A is configured to connect to and/or mate with the second connecting unit 512. More specifically, the first connecting member 506A is configured to fit within the slot provided by the first connecting unit 510. In other words, when connected with the first connecting unit 510, the first connecting member 506A is configured to fit within an interior space provided by the bounds of the first wall 510A, the second wall 510B, the third wall 510C, and a portion of the corresponding sidewall 254. Similarly, when connected with the second connecting unit 512, the second connecting member 508 is configured to fit within an interior space provided by the bounds of the first wall 512A, the second wall 512B, the third wall 512C, and a corresponding portion of the sidewall 252. Alternatively, in an example embodiment, these connecting components can be reversed or combined in different configurations on the first and second retaining parts 504A and 504B so long as they are able to establish the requisite connection between the first retaining part 504A and the second retaining part 504B. Accordingly, with these connections, the main body 502 includes a first retaining part 504A, which is configured to connect to and align with the second retaining part 504B.

As described above, the hang tag 200 includes a number of advantageous features. For example, the hang tag 200 includes a retaining portion 208/504 with a first retaining part 208A/504A and a second retaining part 208B/504B. More specifically, for instance, the first retaining part 208A/504A includes a front side, which is angled in a manner that provides enhanced rigidity and enhanced label viewing. The hang tag 200 is also structured such that a security device may be securely attached to the first retaining part 208A/504A, the second retaining part 208B/504B, or both the first and second retaining parts 208A/504A and 208B/504B while also being hidden from view.

In addition, the hang tag 200 is structured such that various portions of an object, when held by the hang tag 200, are viewable at the same time. For example, the hang tag 200 includes a display portion 206 that provides a view of a first end portion of the object, when disposed in the hang tag 200. In addition, the hang tag 200 is structured such that the second end portion of the object, when disposed within the hang tag 200, remains free. That is, the hang tag 200 advantageously enables an individual to inspect both the first end of the object and the second end of the object simultaneously. This simultaneous viewing of both ends of the object while held in the hang tag 200 is advantageous in preventing an individual from forcibly removing the object from the hang tag 200 to confirm that the selected object is indeed the desired object.

Moreover, as discussed above, the hang tag 200 includes a retaining portion 208/504 that includes a number of structural features that are configured to provide a secure hold on an object, such as a drill bit 300. In this regard, for instance, the retaining portion 208/504 includes a first holding portion 244 and a second holding portion 246 that engage and hold the object. In addition, the retaining portion 208/504 is configured to include and accommodate an insert 400/402, which is flexible and prevents a movement of the object within the hang tag 200. Also, the retaining portion 208 includes several other features, such as a first supporting structure with protrusions 262 and a second supporting structure with protrusions 264, which are configured to align and maintain the object in a proper position within the hang tag 200. Accordingly, with the features disclosed herein, the hang tag 200 is configured to hold and display an object in a secure manner.

That is, the above description is intended to be illustrative, and not restrictive, and is provided in the context of a particular application and its requirements. Those skilled in the art can appreciate from the foregoing description that this disclosure may be implemented in a variety of forms, and that the various embodiments may be implemented alone or in combination. Therefore, while the embodiments of this disclosure have been described in connection with particular examples thereof, the general principles defined herein may be applied to other embodiments and applications without departing from the spirit and scope of the described embodiments, and the true scope of the embodiments and/or methods of this disclosure are not be limited to the embodiments shown and described, since various modifications will become apparent to the skilled practitioner upon a study of the drawings, specification, and following claims. For example, components and functionality may be separated or combined differently than in the manner of the various described embodiments, and may be described using different terminology. These and other variations, modifications, additions, and improvements may fall within the scope of the disclosure as defined in the claims that follow.

What is claimed is:

1. A product display package for an object, the product display package comprising:

a display portion including a frame structure with at least one opening that provides a view of the object when disposed in the product display package; and a retaining portion including (i) a first retaining part that includes a first holding portion with a first set of ribs configured to engage the object, the first set of ribs being angled with respect to a longitudinal axis of the product display package, and (ii) a second retaining part configured to mate with the first retaining part such that the second retaining part is secured to the first retaining part, the second retaining part including a second holding portion with a second set of ribs configured to engage the object.

2. The product display package of claim 1, wherein the second set of ribs is angled with respect to the longitudinal axis of the product display package.

3. The product display package of claim 1, wherein:

each rib of the first set of ribs includes a curved surface that engages with the object; and each rib of the second set of ribs includes a curved surface that engages with the object.

4. The product display package of claim 1, further comprising:

an insert configured to engage with the object when disposed in the product display package, wherein the second retaining part includes at least one fastener that is configured to hold the insert over the second set of ribs, the insert being positioned between the first retaining part and the second retaining part.

5. The product display package of claim 1, wherein:

the first retaining part comprises (i) a first side that includes a ridge and angled surfaces and (ii) a second side that includes the first set of ribs.

6. The product display package of claim 1, wherein:

the first retaining part and the second retaining part include mating components that enable the first retaining part to be secured to the second retaining part;

the mating components include tapered holes as a first mating component and locking pins as a second mating component;

the first retaining part includes either the first mating component or the second mating component; and the second retaining part includes a different one of the mating components than that of the first retaining part.

7. The product display package of claim 1, wherein:

the first retaining part includes a first connecting member;

the second retaining part includes a first connecting unit; and the first connecting member and the first connecting unit are mechanical structures that are configured to provide a secure connection between the first retaining part and the second retaining part.

8. A hang tag for an object, the hang tag comprising:

a retaining portion including (a) a first retaining part that includes (i) a first side with a ridge and angled surfaces, and (ii) a second side with a first holding portion having a first set of ribs configured to engage the object, and (b) a second retaining part configured to mate with the first retaining part such that the second retaining part is secured to the first retaining part, the second retaining part including a second holding portion with a second set of ribs configured to engage the object, wherein:

the first set of ribs include a first rib and a second rib;

the first rib is angled with respect to a longitudinal axis of the hang tag; and the second rib is parallel to the first rib.

9. The hang tag of claim 8, further comprising:

a display portion including a frame structure with at least one opening that provides a view of the object when disposed in the hang tag, wherein the display portion is positioned above the retaining portion when the hang tag is in a hanging state.

10. The hang tag of claim 8, wherein:

the second set of ribs include a first rib and a second rib;

the first rib of the second set is angled with respect to a longitudinal axis of the hang tag; and the second rib of the second set is parallel to the first rib of the second set.

11. The hang tag of claim 8, further comprising:

an insert configured to engage with the object when disposed in the hang tag, wherein the second retaining part includes at least one fastener that is configured to hold the insert over the second set of ribs, the insert being positioned between the first retaining part and the second retaining part.

12. The hang tag of claim 8, wherein:

the first retaining part and the second retaining part include mating components that enable the first retaining part to be secured to the second retaining part;

the mating components include tapered holes as a first mating component and locking pins as a second mating component;

the first retaining part includes either the first mating component or the second mating component; and the second retaining part includes a different one of the mating components than that of the first retaining part.

13. The hang tag of claim 8, wherein:

the first retaining part includes a first connecting member;

the second retaining part includes a first connecting unit; and the first connecting member and the first connecting unit are mechanical structures that are configured to provide a secure connection between the first retaining part and the second retaining part.

14. The hang tag of claim 8, further comprising:

a display portion including a frame structure with at least one opening that provides a view of the object when disposed in the hang tag, wherein:

the frame structure has a height that extends along an axis of the frame structure that is perpendicular to the longitudinal axis;

the first set of ribs have a height that extends along another axis that is parallel to the axis of the frame structure; and the height of the frame structure is greater than the height of a portion of the first set of ribs.

15. An apparatus comprising:

a drill bit with a shank at one end portion and a cutting edge at another end portion; and a hang tag configured to hold the drill bit with the cutting edge pointing upward when the hang tag is hung in an upright manner, the hang tag including:

(a) a display portion including a frame structure with at least one opening that provides a view of the cutting edge when the drill bit is disposed in the hang tag; and (b) a retaining portion including (i) a first retaining part that includes a first holding portion with a first set of ribs configured to engage flutes of the drill bit, and (ii) a second retaining part configured to mate with the first retaining part such that the second retaining part is secured to the first retaining part, the second retaining part including a second holding portion with a second set of ribs configured to engage flutes of the drill bit.

16. The apparatus of claim 15, wherein:

the first set of ribs include a first rib and a second rib;

the first rib is angled with respect to a longitudinal axis of the hang tag; and the second rib is parallel to the first rib.

17. The apparatus of claim 15, wherein:

the second set of ribs include a first rib and a second rib;

the first rib is angled with respect to a longitudinal axis of the hang tag; and the second rib is parallel to the first rib.

18. The apparatus of claim 15, further comprising:

an insert configured to engage with the drill bit when disposed in the hang tag, wherein the retaining portion includes at least one fastener that is configured to hold the insert over the second set of ribs, the insert being positioned between the first retaining part and the second retaining part.

19. The apparatus of claim 15, wherein:

the first retaining part comprises (i) a first side that includes a ridge and angled surfaces and (ii) a second side that includes the first set of ribs.

20. The apparatus of claim 15, wherein:

the first retaining part and the second retaining part include mating components that enable the first retaining part to be secured to the second retaining part;

the mating components include tapered holes as a first mating component and locking pins as a second mating component;

the first retaining part includes either the first mating component or the second mating component; and the second retaining part includes a different one of the mating components than that of the first retaining part.

* * * * *